US005912050A

United States Patent [19]

Zeigler et al.

[11] Patent Number: 5,912,050

[45] Date of Patent: Jun. 15, 1999

[54] METHOD FOR CHROMIZING SMALL PARTS

[75] Inventors: Douglas D. Zeigler, Atwater; James M. Tanzosh, Silver Lake; Walter R. Mohn, North Canton, all of Ohio

[73] Assignees: McDermott Technology, Inc.; The Babcock & Wilcox Company, both of New Orleans, La.

[21] Appl. No.: 08/938,319

[22] Filed: Sep. 26, 1997

[51] Int. Cl.[6] ..... B05D 3/12; B05D 1/12; C23C 22/24

[52] U.S. Cl. ..... 427/252; 427/191; 427/305; 427/347; 427/376.8; 427/383.7; 427/421; 427/427; 148/264; 148/605

[58] Field of Search ..... 427/191, 192, 427/252, 305, 347, 376.8, 383.7, 421, 427; 148/264, 605

[56] References Cited

U.S. PATENT DOCUMENTS

| | | | |
|---|---|---|---|
| 3,753,758 | 8/1973 | Shanley | 117/25 |
| 3,775,151 | 11/1973 | Baker et al. | 117/33 |
| 4,041,196 | 8/1977 | Baldi et al. | 427/252 |
| 4,066,806 | 1/1978 | Speirs et al. | 427/253 |
| 4,157,001 | 6/1979 | Pickles | 52/506 |
| 4,350,719 | 9/1982 | Baldi | 427/253 |
| 4,904,501 | 2/1990 | Davis | 427/253 |
| 5,041,309 | 8/1991 | Davis et al. | 427/217 |
| 5,135,777 | 8/1992 | Davis et al. | 427/217 |

*Primary Examiner*—Shrive Beck
*Assistant Examiner*—Michael Barr
*Attorney, Agent, or Firm*—Robert J. Edwards; Eric Marich

[57] ABSTRACT

An improved process for chromizing commercial quantities of small, industrial, ferrous-based parts, such as but not limited to threaded connectors, pins, bolts, nuts, washers, fasteners, fittings, couplings, studs, etc., uses a retort filled with layers of parts coated with a chromium-containing slurry. The plurality of parts are arranged in layers on sheets of refractory felt paper and are heat treated simultaneously for causing the chromizing reaction between the slurry and the ferrous-based parts.

18 Claims, 1 Drawing Sheet

METHOD FOR CHROMIZING SMALL PARTS

FIELD AND BACKGROUND OF THE INVENTION

The present invention relates generally to the field of applying diffusion coatings to industrial parts, and in particular to a new and useful process for chromizing commercial quantities of small, individual, ferrous-based industrial parts in a rapid and cost efficient manner.

Chromizing is a process of producing a chromium diffusion coating on ferrous-base components to improve corrosion resistance, especially at elevated temperatures. Chromizing was developed to produce an integral protective surface coating on components exposed to extreme conditions to enhance their usable life.

Chromizing of parts such as bolts, screws, studs and the like is commonly accomplished using a powder pack cementation technique. In this technique, the parts are packed into dry powder mixtures of aluminum oxide, chromium, and activator salts within a retort, which is then sealed and heated. During the heating, the temperature of the retort is raised to an elevated level and held for a predetermined amount of time. A chemical reaction takes place during the heating process which causes a surface layer of high chromium content to be diffused into the iron of the ferrous-based parts. The retort and parts are cooled and the parts, now with a layer of chromium coating are removed from the retort.

However, the pack cementation method has significant drawbacks when used to coat such small, individual parts. The coating thicknesses often vary widely between individual coated parts, or across the surfaces of larger parts. This is caused by the poor thermal conductivity of the powder pack and the resulting very slow and non-uniform heating rates for the packed parts. Another drawback of this process is that if the parts come into direct contact with each other, the chromium coating diffusion bonds the parts together at these contact points. Further, a large volume of powder waste is generated by the process.

U.S. Pat. No. 4,904,501 to Davis, assigned to The Babcock & Wilcox Company, discloses an improved method for chromizing the surface of a ferritic boiler component which involves applying aqueous coating compositions containing chromium directly to the surface to be chromized. The aqueous compositions include chromium, alumina, a binder of ammonium alginate or methyl cellulose, and a halide activator.

Other processes which improve on the pack cementation technique are disclosed in U.S. Pat. Nos. 5,135,777 and 5,041,309 to Davis et al., also assigned to The Babcock & Wilcox Company. In these processes, an inert refractory container or a ceramic carrier is first coated with a slurry of a diffusion composition. The diffusion composition may contain chromium as the diffusion element. Then the carrier or container is inserted within or placed upon a workpiece to be coated, and heat treated to diffuse a coating onto the workpiece. The carrier or container is removed following the heat treatment. This process is sometimes referred to as a "blanket" process, since the inert carrier is often a spun alumina-silica fiber paper or blanket.

The blanket chromizing process is useful for obtaining uniform coatings with minimal waste on large surfaces or large continuous areas. However, that process has limited benefits when chromizing small individual parts, such as threaded bolts, studs and the like. For example, to chromize carbon steel studs (such as those weld-attached to boiler tubes), special handling is required when using pack cementation and blanket processes to ensure proper positioning to avoid fusing the studs together at points of metal-to-metal contact during the heat treatment process. This special handling is a time-consuming process that has limited benefit, since the parts often shift during the process and thus still become fused together. Additional processing time is then required to separate the usable parts and reject unevenly coated pieces.

SUMMARY OF THE INVENTION

It is an object of the present invention to provide an improved chromizing process which permits the rapid and economical coating of commercial quantities of small individual parts.

It is a further object of the invention to provide a process which evenly coats ferrous-based pieces with a chromium diffusion layer to enhance the durability of the pieces in extreme conditions.

Accordingly, one aspect of the present invention is drawn to a method of simultaneously chromizing a plurality of small, individual, ferrous-based parts. According to this method, a retort is provided having a bottom lined with sheet of refractory felt paper. A plurality of small, individual, ferrous-based parts to be chromized are placed on the sheet of refractory felt paper, the plurality of parts and the sheet of refractory felt paper forming a first layer. The parts are spray coated with a chromium-containing slurry and dried, either before, during, or after sealing the retort. Advantageously, the chromium-containing slurry is comprised of alumina, chromium, and water, but if it is desired to co-diffuse additional elements such as silicon, aluminum, vanadium, molybdenum, titanium, columbium, tungsten, and tantalum into the parts, these additional substances can also be included in the chromium-based slurry. After sealing, the retort is heated to a temperature and for a time sufficient to cause a chemical reaction to chromize the plurality of ferrous-based parts. Additional layers of parts may be placed over the first layer after first placing a sheet of refractory felt paper or, if desired, a chromizing blanket thereon, such that a plurality of layers fills the retort. Each of the layers of slurry-coated parts have a sheet of refractory felt paper between them. The retort may be filled in this manner and then all the layers of the slurry-coated parts are dried either before, during, or after sealing of the retort. Once the retort is scaled, it is heated to a temperature and for a time sufficient to cause a chemical reaction to chromize the plurality of ferrous-based parts. The resulting chromized parts may then be removed from the retort for final processing (cleaning) and use.

Another aspect of the present invention is drawn to an alternative method of simultaneously chromizing a plurality of small, individual, ferrous-based parts. This method again comprises the steps of providing a retort having a bottom and lining the bottom of the retort with a sheet of refractory felt paper. However, instead of placing the plurality of ferrous-based parts on the refractory felt paper and then spray-coating them with a chromium-containing slurry, the parts are first coated with a chromium-containing slurry, and then placed on the sheet of refractory felt paper. Again, the plurality of parts and the sheet of refractory felt paper form a layer. The plurality of coated parts are dried either before, during, or after sealing of the retort. Again, once the retort is sealed, it is heated to a temperature and for a time sufficient to cause a chemical reaction to chromize the plurality of ferrous-based parts. The plurality of ferrous-based parts may be coated with the chromium-based slurry by tumbling in a large container filled with the slurry. If it is desired to co-diffuse additional elements such as silicon, aluminum, vanadium, molybdenum, titanium, columbium, tungsten, and tantalum into the parts, these additional substances can also be included in the chromium-based slurry in which the parts are tumbled.

Yet another aspect of the present invention is drawn to a method of producing a co-diffusion coating of chromium and at least one member from the group consisting of silicon, aluminum, vanadium, molybdenum, titanium, columbium, tungsten, and tantalum simultaneously on a plurality of small, individual, ferrous-based parts. The method comprises the steps of providing a retort having a bottom and lining the bottom of the retort with a sheet of refractory felt paper. A plurality of small, individual, ferrous-based parts to be diffusion coated are placed on the sheet of refractory felt paper, the plurality of parts and the sheet of refractory felt paper forming a first layer. The plurality of parts are then spray coated with a slurry containing alumina, chromium, water, a binder and at least one member from the group consisting of silicon, aluminum, vanadium, molybdenum, titanium, columbium, tungsten, and tantalum, and dried, either before, during, or after sealing of the retort. Once the retort is sealed, it is heated to a temperature and for a time sufficient to cause a chemical reaction to produce a co-diffusion coating on each of the plurality of ferrous-based parts.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

The process of the invention provides an improved method for diffusion coating commercial quantities of ferrous-based individual small parts such as, by way of example only and not limitation: bolts, nuts, washers, fasteners, fittings, couplings, studs, etc. or other similar pieces with a high concentration chromium layer diffused thereon.

Figure 1:
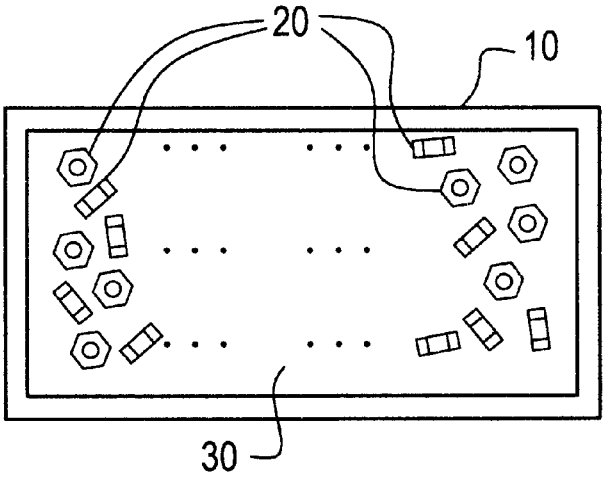
FIG. 1 is a top plan view of a retort for use with the process of the invention.
Figure 2:
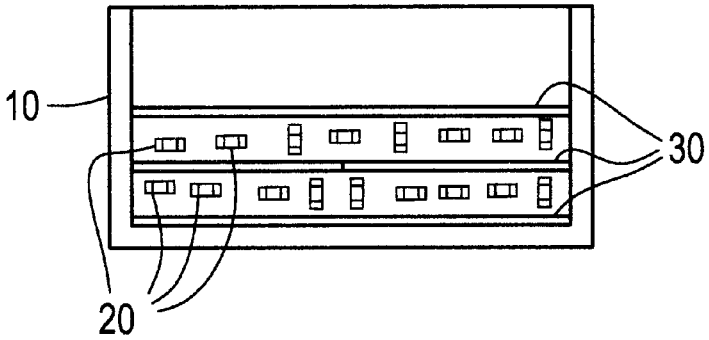
FIG. 2 is a sectional side elevation view showing layers of parts in a retort for use with the process of the invention.

Referring to the drawings, first a retort 10, such as that shown in FIGS. 1 and 2, is provided. A refractory felt paper 30 is placed on the bottom of the retort 10. The refractory felt paper 30 may be any known refractory felt paper, such as that made of commercially available FIBERFRAX® ceramic fiber, available from Unifrax Corporation, or KAOWOOL® ceramic fiber, available from ThermalCeramics. It can also comprise a sheet of thin, insulating blanket material.

Then, many small individual parts 20 (shown as hexagonal nuts and cylindrical pins for example) are placed on the felt paper 30, and the plurality of ferrous-based parts and the refractory felt paper can be considered a single layer. The small parts 20 may be in contact with each other, and yet when they are chromized or diffusion coated according to the method of the present invention they will not fuse together as they would if a pack cementation process was employed. The principal reason for this is believed to be the presence of the alumina, which acts to prevent bonding between individual parts. While alumina is preferred for this purpose, it is also believed that any non-reactive, ceramic oxide inert filler will accomplish the same function. After the layer of parts 20 on the felt paper 30 is arranged, a chromizing slurry is sprayed onto the parts 20, substantially coating all accessible areas of the parts with the slurry. This is an important advantage of the present invention, since complete coverage of the entire surface of an individual part is not required to achieve a commercially suitable chromium diffusion layer on the part after heat treatment. The chromizing slurry is composed of alumina powder, chromium powder, a binder, and water in a preferred mixture, although other chromizing mixtures in slurry form may be used as well. The chromium in the slurry is the source of the material which forms the primary diffusion coating on the parts. The alumina in the slurry serves to establish a uniform distribution of chromium powder and to prevent the parts from fusing together. The water serves as the vehicle to form the slurry for spray application to the parts.

Spray-coating of the chromium-containing slurry onto the parts 20 can be readily accomplished using an air-atomized paint sprayer. In preparing the slurry, the powder constituents are first blended dry, and then mixed with a 2% solution (in deionized water) of methyl cellulose (a binder). Dry blended powder constituents are mixed with the methyl cellulose solution proportionally, by weight, in a ratio of 70 to 30. As indicated above, aluminum and silicon may be co-diffused into the parts 20, along with the chromium, and this results in the following blend compositions:

Alumina Slurry

Dry alumina powder—70% by weight

Methyl cellulose solution—30% by weight

Chrome/Alumina Slurry

Dry 50/50 chromium/alumina powder blend—70% by weight

Methyl cellulose solution—30% by weight

Chrome/Silicon/Alumina Slurry

Dry 20/5/75 chromium/silicon/alumina powder blend—70% by weight

Methyl cellulose solution—30% by weight

Once the first layer of parts 20 is coated with chromizing slurry, another piece of refractory felt paper 30 may be placed over the first layer to form the base for a second layer on top of the first layer, such as shown in FIG. 2. The felt paper 30 prevents interaction between the layers and provides a non-reactive separator between the many parts 20 forming each of the layers. Each successive layer is similarly spray coated with chromizing slurry before another sheet of felt paper 30 is placed over the layer. If desired, some or all of the refractory felt paper may be replaced with a chromizing blanket impregnated with the slurry to further tailor the diffusion layer created on the ferrous-based parts.

In this manner, many parts 20 of the same or different kinds (by way of example only and not limitation: bolts, nuts, washers, fasteners, fittings, couplings, studs, etc.) may be simultaneously placed in the retort 10 for chromizing. Once the retort 10 is full of layers, the slurry is dried. While the drying step is important to drive off any moisture before the diffusion coating heating schedule regimen occurs, it is understood that the drying step could occur before, during, or after sealing of the retort. If necessary, an inert gas such as argon or nitrogen could be introduced into one part of the retort as it is being sealed or after sealing. The exhausted air and moisture could be removed from an outlet located elsewhere on the retort. This drying step could be done for each layer, but it would be preferred to dry all the parts in the retort at one time.

Once it is sealed, the retort 10 is heated in a known manner, such as by raising the temperature of the retort 10 to an elevated temperature (such as by placing it in a furnace) and then maintaining the temperature for a sufficiently long time to allow the chromizing slurry to interact with the iron in the ferrous-based parts 20 and create a surface layer of high chromium concentration on each part 20 which was coated with chromizing slurry. The retort 10 is then cooled and the chromized parts 20 removed from each sheet of felt paper 30 forming the bases of the layers. The parts 20 are then placed in a rotating drum and tumbled to remove residual debris from the chromized parts 20 prior to inspection and use. For details on typical chromizing heating schedules, as well as the manner in which such chromizing blankets which could be used in place of or in addition to the refractory felt paper are made, the reader is referred to the aforementioned U.S. Pat. Nos. 4,904,501, 5,135,777 and 5,041,309, the text of which is fully incorporated by reference as though fully set forth herein.

Microscopic examination of sample parts chromized according to the process described showed a uniform coating, generally achieving a diffusion coating layer of about approximately 10 mils thick formed on each of the parts examined. If the chromized parts are threaded fasteners, rough surfaces resulting from any minor sticking or retention of spent slurry particles are easily smoothed using an electropolishing technique, which facilitates thread engagement. The technique was also applied to automotive tube couplings, and the electropolishing step improved their appearance. The electropolishing technique used a 15% concentration of sulfuric acid as an electrolyte with a potential of between 10 and 12 volts at a current density of 4 to 5 amps/$dm^3$ for 7 minutes per piece.

In one alternate method for coating the parts 20 with slurry, the parts 20 are first coated with the chromizing slurry in a tumbler, and then placed in layers within the retort 10 on sheets of refractory felt paper 30. The remainder of the process is the same as described above.

While a specific embodiment of the invention has been shown and described in detail to illustrate the application of the principles of the invention, it will be understood that the invention may be embodied otherwise without departing from such principles. As indicated earlier, while the present invention is primarily directed to the efficient production of commercial quantities of chromized, ferrous-based parts, the method of the present invention can be readily adapted to produce co-diffused layers of chromium and at least one or more other elements, such as silicon, aluminum, vanadium, molybdenum, titanium, columbium, tungsten, and tantalum.

We claim:

1. A method of simultaneously chromizing a plurality of individual, ferrous-based parts, comprising the steps of:

providing a retort having a bottom and lining the bottom of the retort with a sheet of refractory felt paper;

placing a plurality of individual, ferrous-based parts to be chromized on the sheet of refractory felt paper, the plurality of parts and the sheet of refractory felt paper forming a first layer;

spray coating the plurality of parts with a chromium-containing slurry;

adding a second layer over the first layer in the retort, spray coating a plurality of parts in the second layer with a chromium-containing slurry, and drying the plurality of spray-coated parts in each of the layers; and heating the retort to a temperature and for a time sufficient to cause a chemical reaction to chromize the plurality of ferrous-based parts.

2. The method according to claim 1, further comprising the steps of adding additional layers to the retort until the retort is filled, spray coating a plurality of parts in each of the additional layers with a chromium-containing slurry, and drying the plurality of spray-coated parts in all of the layers.

3. The method according to claim 1, wherein at least one of the layers comprises a refractory felt paper impregnated with the chromium-containing slurry.

4. The method according to claim 1, further comprising removing the plurality of parts from the retort following heat treating and tumbling the plurality of parts to remove residual debris thereon.

5. The method according to claim 1, wherein the chromium-containing slurry comprises alumina powder, chromium powder, a binder, and water.

6. The method according to claim 1, wherein the chromium-containing slurry comprises alumina powder, chromium powder, a binder, water and at least one of silicon, aluminum, vanadium, molybdenum, titanium, columbium, tungsten, and tantalum.

7. A method of simultaneously chromizing a plurality of individual, ferrous-based parts, comprising the steps of:

providing a retort having a bottom and lining the bottom of the retort with a sheet of refractory felt paper;

coating a plurality of ferrous-based parts with a chromium-containing slurry;

placing the plurality of coated parts on the sheet of refractory felt paper, the plurality of parts and the sheet of refractory felt paper forming a first layer;

adding a second layer of coated parts over the first layer in the retort, and drying the plurality of coated parts in each of the layers; and heating the retort to a temperature and for a time sufficient to cause a chemical reaction to chromize the plurality of ferrous-based parts.

8. The method according to claim 7, further comprising the steps of adding additional layers of coated parts to the retort until the retort is filled, and drying the plurality of coated parts in all of the layers.

9. The method according to claim 7, wherein at least one of the layers comprises a refractory felt paper impregnated with the chromium-containing slurry.

10. The method according to claim 7, further comprising removing the plurality of parts from the retort following heat treating and tumbling the plurality of parts to remove residual debris thereon.

11. The method according to claim 7, wherein the chromium-containing slurry comprises alumina powder, chromium powder, a binder, and water.

12. The method according to claim 7, wherein the chromium-containing slurry comprises alumina powder, chromium powder, a binder, water and at least one of silicon, aluminum, vanadium, molybdenum, titanium, columbium, tungsten, and tantalum.

13. A method of producing a co-diffusion coating of chromium and at least one member from the group consisting of silicon, aluminum, vanadium, molybdenum, titanium, columbium, tungsten, and tantalum simultaneously on a plurality of individual, ferrous-based parts, comprising the steps of:

providing a retort having a bottom and lining the bottom of the retort with a sheet of refractory felt paper;

placing a plurality of individual, ferrous-based parts to be diffusion coated on the sheet of refractory felt paper, the plurality of parts and the sheet of refractory felt paper forming a first layer;

spray coating the plurality of parts with a slurry containing alumina, chromium, water, a binder and at least one member from the group consisting of silicon, aluminum, vanadium, molybdenum, titanium, columbium, tungsten, and tantalum;

adding a second layer over the first layer in the retort, spray coating a plurality of parts in the second layer with a slurry containing alumina, chromium, water, a binder and at least one member from the group consisting of silicon, aluminum, vanadium, molybdenum, titanium, columbium, tungsten, and tantalum and drying the plurality of spray coated parts in each of the layers; and heating the retort to a temperature and for a time sufficient to cause a chemical reaction to produce a co-diffusion coating on each of the plurality of ferrous-based parts.

14. The method according to claim 13, further comprising the steps of adding additional layers to the retort until the retort is filled, spray coating a plurality of parts in each of the additional layers with the slurry containing alumina, chromium, water, a binder and at least one member from the group consisting of silicon, aluminum, vanadium, molybdenum, titanium, columbium, tungsten, and tantalum, and drying the plurality of spray-coated parts in all of the layers.

15. The method according to claim 13, wherein at least one of the layers comprises a refractory felt paper impregnated with the slurry containing alumina, chromium, water, a binder and at least one member from the group consisting of silicon, aluminum, vanadium, molybdenum, titanium, columbium, tungsten, and tantalum.

16. A method of producing a co-diffusion coating of chromium and at least one member from the group consisting of silicon, aluminum, vanadium, molybdenum, titanium, columbium, tungsten, and tantalum simultaneously on a plurality of individual, ferrous-based parts, comprising the steps of:

providing a retort having a bottom and lining the bottom of the retort with a sheet of refractory felt paper;

coating a plurality of ferrous-based parts with a slurry containing alumina, chromium, water, a binder and at least one member from the group consisting of silicon, aluminum, vanadium, molybdenum, titanium, columbium, tungsten, and tantalum;

placing the plurality of coated parts on the sheet of refractory felt paper, the plurality of parts and the sheet of refractory felt paper forming a first layer;

adding a second layer of coated parts over the first layer in the retort and drying the plurality of coated parts in each of the layers; and heating the retort to a temperature and for a time sufficient to cause a chemical reaction to produce a co-diffusion coating on each of the plurality of ferrous-based parts.

17. The method according to claim 16, further comprising the steps of adding additional layers of coated parts to the retort until the retort is filled, and drying the plurality of coated parts in all of the layers.

18. The method according to claim 16, wherein at least one of the layers comprises a refractory felt paper impregnated with the slurry containing alumina, chromium, water, a binder and at least one member from the group consisting of silicon, aluminum, vanadium, molybdenum, titanium, columbium, tungsten, and tantalum.

* * * * *